US008347974B2

(12) United States Patent
Calvert et al.

(10) Patent No.: US 8,347,974 B2
(45) **Date of Patent: *Jan. 8, 2013**

(54) SAFETY LOCKING DEVICE

(76) Inventors: Matthew James Calvert, Wellington (NZ); David Aperahama Calvert, Lower Hutt (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 12/892,023

(22) Filed: Sep. 28, 2010

(65) Prior Publication Data

US 2011/0010915 A1 Jan. 20, 2011

Related U.S. Application Data

(63) Continuation of application No. 11/797,266, filed on May 2, 2007, now Pat. No. 7,828,070.

(30) Foreign Application Priority Data

May 2, 2006 (NZ) ..... 546893
Dec. 22, 2006 (NZ) ..... 552294

(51) Int. Cl.
*A01B 51/00* (2006.01)

(52) U.S. Cl. ..... 172/272; 414/723

(58) Field of Classification Search ..... 172/272, 172/273, 275; 280/504, 507, 508; 414/723
See application file for complete search history.

(56) References Cited

U.S. PATENT DOCUMENTS 3,511,316 A 5/1970 Herman et al.
3,587,750 A 6/1971 Central et al.
4,014,562 A 3/1977 Kunze
4,624,196 A 11/1986 Anderson
5,048,274 A 9/1991 Jennings
5,050,684 A 9/1991 Vollmer
5,082,389 A * 1/1992 Balemi ..... 403/322.3
5,147,173 A * 9/1992 Fauber et al. ..... 414/723
5,179,794 A 1/1993 Ballinger
5,244,047 A * 9/1993 Eudy ..... 172/275
5,727,342 A 3/1998 Horton
5,890,871 A 4/1999 Woerman
6,058,633 A * 5/2000 Barden ..... 37/468
6,132,131 A * 10/2000 Nakamura et al. ..... 403/322.1
(Continued)

FOREIGN PATENT DOCUMENTS

DE 20119092 U1 1/2002
(Continued)

OTHER PUBLICATIONS

European Search Report dated Mar. 3, 2009, Application No. 07 25 1831.

*Primary Examiner* — Thomas B Will
*Assistant Examiner* — Joel F. Mitchell
(74) *Attorney, Agent, or Firm* — Chernoff, Vilhauer, McClung & Stenzel, LLP

(57) ABSTRACT

A safety locking device 18 for a quick hitch/coupler 10 of an earth working machine. The safety locking device 18 has a locking element 21 which is biased into a locking position to automatically lock a front pin of an implement when it is engaged in the hook 14 of the coupler 10. The safety locking device 18 has an hydraulic operable mechanism to move the locking element 21 to an unlocking position. The hydraulic supply to the safety locking device 18 is independent of the hydraulic supply to a locking mechanism 16 of the coupler 10.

9 Claims, 10 Drawing Sheets

U.S. PATENT DOCUMENTS

| | | | | |
|---|---|---|---|---|
| 6,139,212 | A | 10/2000 | Heiple | |
| 6,163,989 | A | 12/2000 | Kaczmarski et al. | |
| 6,254,331 | B1 * | 7/2001 | Pisco et al. | 414/723 |
| 6,301,811 | B1 | 10/2001 | Gilmore | |
| 6,379,075 | B1 * | 4/2002 | Shamblin et al. | 403/322.1 |
| 6,422,805 | B1 | 7/2002 | Miller | |
| 6,625,909 | B1 | 9/2003 | Miller et al. | |
| 6,691,438 | B2 | 2/2004 | Fatemi | |
| 6,699,001 | B2 | 3/2004 | Fatemi | |
| 6,902,346 | B2 * | 6/2005 | Steig et al. | 403/322.3 |
| 6,922,926 | B2 * | 8/2005 | Miller et al. | 37/468 |
| 6,964,122 | B2 * | 11/2005 | Cunningham et al. | 37/468 |
| 7,367,256 | B2 * | 5/2008 | Fatemi et al. | 91/432 |
| 7,493,712 | B2 | 2/2009 | McCormick et al. | |
| 7,530,405 | B2 | 5/2009 | Kollath et al. | |
| 7,828,070 | B2 * | 11/2010 | Calvert et al. | 172/272 |
| 8,006,415 | B2 * | 8/2011 | Short | 37/468 |
| 2008/0142231 | A1 | 6/2008 | Priepke et al. | |
| 2008/0193210 | A1 | 8/2008 | Beales | |
| 2009/0220326 | A1 | 9/2009 | Essex | |

FOREIGN PATENT DOCUMENTS

| | | | |
|---|---|---|---|
| EP | 1477615 | A1 | 11/2004 |
| NZ | 233302 | | 4/1990 |
| NZ | 260659 | | 6/1994 |
| WO | WO 2005/026454 | A1 | 3/2005 |

* cited by examiner

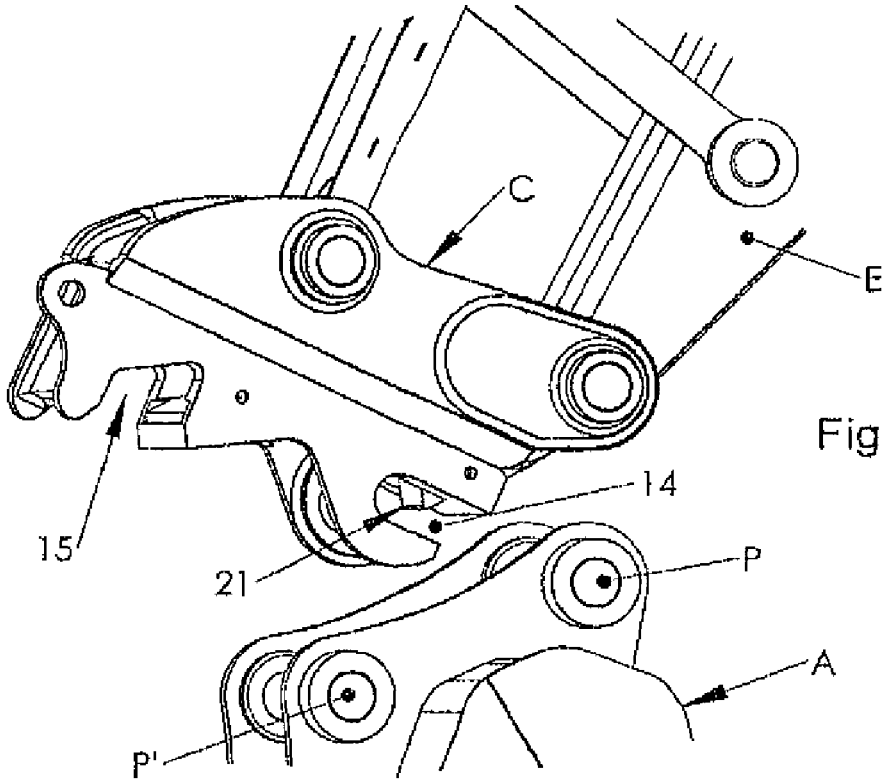
Fig 15.
Fig 16.
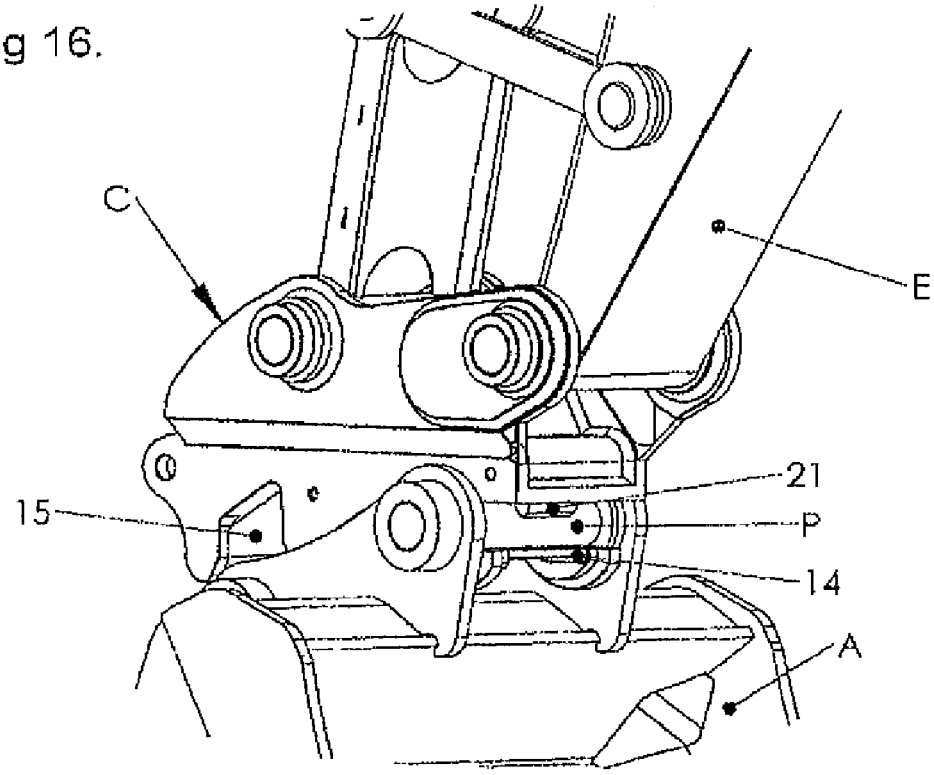

SAFETY LOCKING DEVICE

This application is a continuation of co-pending U.S. patent application Ser. No. 11/797,266, filed on May 2, 2007.

BACKGROUND TO THE INVENTION

This invention relates to a safety locking device for a quick hitch/coupler.

Quick hitches or couplers are used with earth working machines such as excavators whereby an implement such as a bucket can be quickly coupled to or removed from the earth working machine. The quick hitch can thus be attached to the end of the excavator arm.

The quick hitch has a hook portion which is engageable with the so-called "front pin" of an implement. A mounting portion of the quick hitch can then be engaged with the "back pin" of the implement following which a mechanism in the quick hitch is operated to retain the back pin in the mounting portion. When the back pin is so locked into position the front pin is prevented from moving out of the hook portion.

Such quick hitches are widely known and used. The mechanism to lock the back pin in place can take different forms but, in one form, can be a wedge which is moveable by a hydraulic ram. A construction of quick hitch with a wedge mechanism is shown in our New Zealand patent specification nos. 233302 and 260659.

The quick hitch permits the operator of an earth working machine to attach and remove implements without moving from the cab or operating position of the machine. However, a problem that can arise is that the operator may move the part of the machine to which the quick hitch is attached (e.g. an excavator arm) before the back pin is fixed into the mounting portion or the locking mechanism is operated before the back pin is in position in the mounting portion. This can happen because experienced operators tend to position a quick hitch with the implement, lock the quick hitch and move the implement all in one fluid action. Therefore there is the possibility of the operation not being carried out correctly with the result that the implement is not fully locked into the quick hitch.

If incomplete mounting occurs the implement may, when moved, i.e. lifted off the ground, fall from the quick hitch. This creates a situation where damage to the implement can occur or, more seriously, personal injury or death of a bystander can occur due to the uncontrolled movement (falling) of the implement.

It is known to provide in a quick hitch a safety locking device for the front pin so that if incomplete fixing of the back pin occurs, the implement will nevertheless still remain attached by the front pin. These known devices have, however, suffered from drawbacks. For example the safety device may not be failsafe i.e. automatically engage upon the front pin engaging in the hook portion of the quick hitch.

Furthermore many known safety lock devices are controlled by the hydraulic circuit that operates the primary locking mechanism. Sometimes these safety lock devices are mechanically sequenced with the primary locking mechanism which is hydraulic. Thus a failure in the primary locking mechanism hydraulics (allowing unintentional release or movement of the primary locking jaw or wedge from the back pin) could result in the safety lock failing simultaneously due to it being sequential. Thus a failure in the safety lock device hydraulics could result in the locking mechanism failing with potentially disastrous results if this leads to the implement falling from the quick hitch. For example, if there is a seal failure in the ram of the primary locking device, this can result in hydraulic fluid bypass which may cause the hydraulic ram of the locking mechanism to fail to maintain locking of the back pin.

SUMMARY OF THE INVENTION

It is thus an object of the present invention to provide a safety locking device which is of a type that automatically locks the front pin in a quick hitch/coupler and in operation is independent of the quick hitch/coupler primary locking mechanism.

Broadly the invention comprises a safety locking device for a quick hitch/coupler of an earth working machine, the safety locking device including a locking element biased into a locking position to lock a front pin in the hook of the quick hitch/coupler, the safety locking device further including an hydraulic operable mechanism to move the locking element to an unlocking position, said hydraulic mechanism including an hydraulic supply independent of the hydraulic supply to a locking mechanism of the quick hitch/coupler.

BRIEF DESCRIPTION OF THE DRAWINGS

In the following more detailed description of one preferred embodiment of the invention, reference will be made to the accompanying drawings in which:

FIGS. 15-20 are a series of illustrations showing a coupler C incorporating the safety locking device of the present invention engaging with an attachment (e.g. an excavator bucket) and then disconnecting.

DETAILED DESCRIPTION OF PREFERRED EMBODIMENTS OF THE INVENTION

Figure 2:
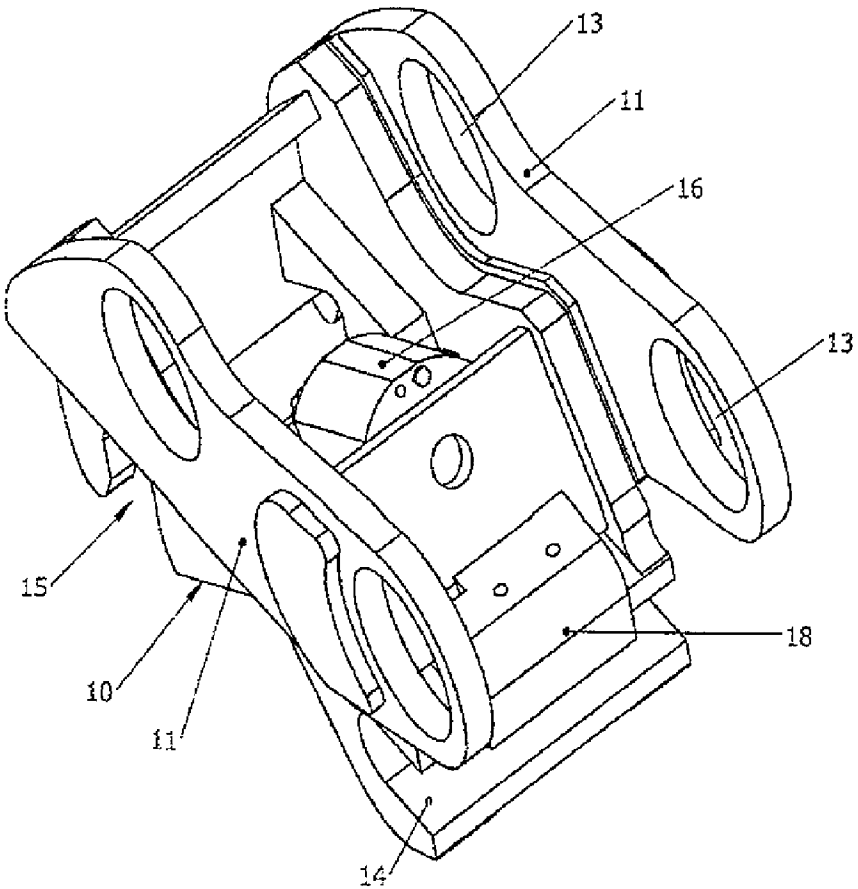
FIG. 2 is a further perspective view of the quick hitch and safety locking device.
Figure 1:
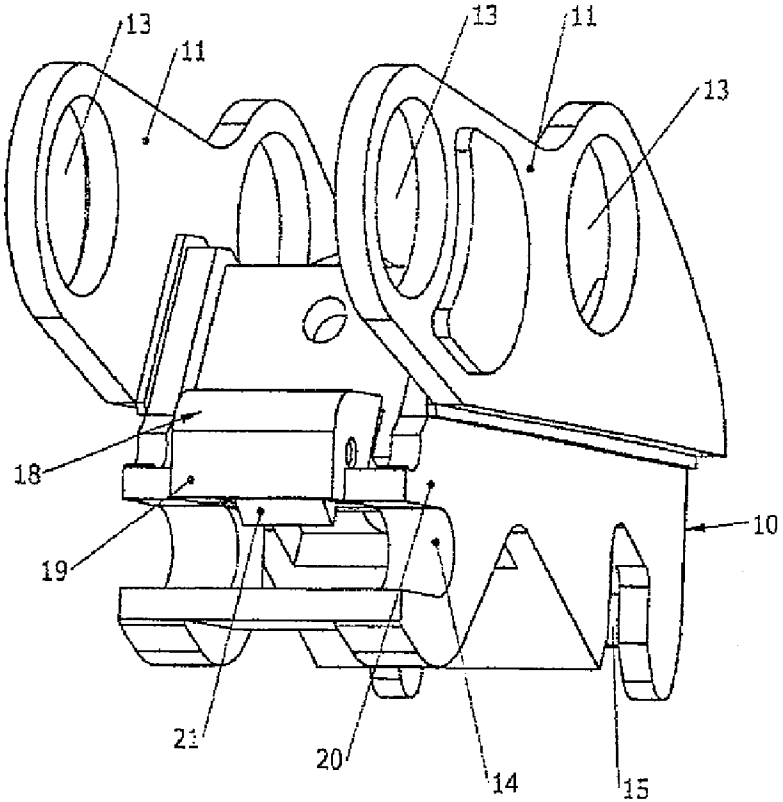
FIG. 1 is a perspective view of the quick hitch with the safety locking device according to one embodiment of the invention fitted thereto.

FIGS. 1 and 2 illustrate a quick hitch/coupler of a type that is manufactured and marketed by Wedgelock Equipment Limited. The coupler is in accordance with conventional construction and includes a body 10 with a pair of upwardly projecting flanges 11 with mounting apertures 13 whereby the coupler 10 can be fixed to the earth working machine e.g. the end of the arm of an excavator.

Figure 12:
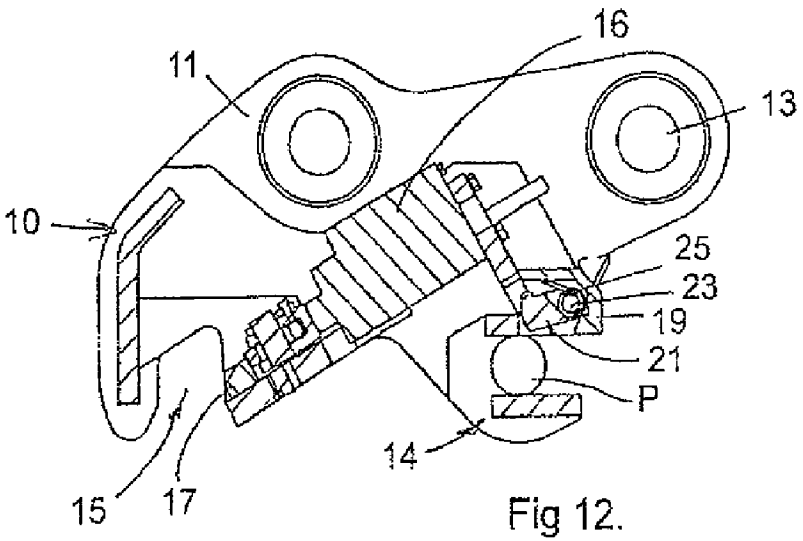
FIG. 12 is section E-E when in the unlocked state.

The body 10 incorporates a hook portion 14 and a mounting portion 15. The coupler includes a locking mechanism. This can be, as illustrated, an hydraulic ram 16 (see FIG. 2) mounted within the body 10 and operable to move a wedge 17 (see FIGS. 12 and 13) so as to lock the back pin of an implement in the mounting portion 15. All of this is in accordance with conventional construction and further description is not required for the purposes of describing the present invention.

As shown in FIGS. 1 and 2 a safety locking device 18 is fitted into the body 10 and, as is more evident in FIG. 1, it in part forms the hook portion 14. In another form of the invention (not shown) the body 19 of the safety locking device 18 can extend further than illustrated so as to form part of the side plates 20 in the immediate vicinity of the hook portion 14. Such an arrangement can provide manufacturing advantages as well as improve the aesthetic appearance of the safety locking device 18 when incorporated in the quick hitch body 10.

Figure 13:
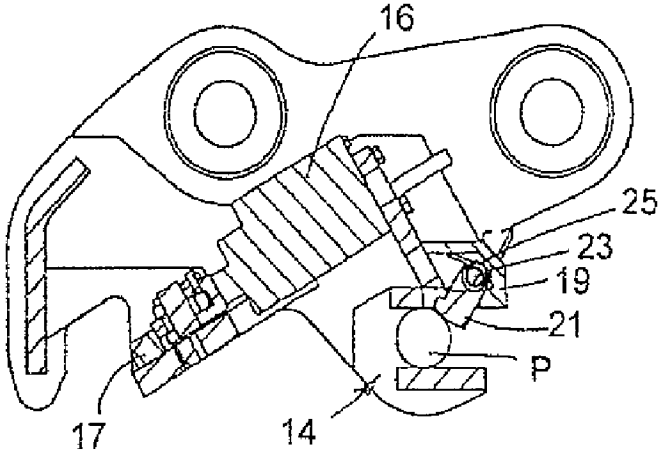
FIG. 13 is a section on line F-F when in the locked state.

Projecting from the body 19 of the safety locking device 18 is a safety knuckle 21. In FIG. 1 this is shown in its normal extended position i.e. locking position. It therefore projects downwardly from the body 19 and, as shown in FIG. 13, engages with the front pin P so as to lock the front pin P into the hook portion 14.

The locking knuckle 21 is biased into this projecting position by a spring bias. Therefore, when the front pin P is introduced into the open end of the hook portion 14 it will cause the locking knuckle 21 to move upwardly against the spring bias as the pin P moves into its position fully inserted into the hook portion 14 (see FIG. 12). Once it has reached this position the lock knuckle 21 will, under the spring bias, move back to its projecting position (i.e. as shown in FIG. 13).

Referring now to FIGS. 2-10, the safety locking device 18 is shown in more detail.

The lock knuckle 21 is mounted on a rotatable shaft 23 (see FIG. 4) and is biased by the coil spring 25. This coil spring 25 is engaged on the shaft 23. One leg 26 of the coil spring 25 engages with a surface 27 of the lock body while the other leg 28 engages against a surface 29 of the knuckle 21.

The shaft 23 has a bore extended diametrically there through and into which is engaged an engagement element in the form of a lug 30. A bolt 31 fixes the lug 30 into place. In the illustrated form of the locking device an opening or passage 32 extends through the body 19 so that the lug can be located into the bore when the shaft 23 is in location within the body 19. A further passage 33 with blanking off plug 34 screwed therein, is provided in order to enable access to the bolt 31 to be achieved.

Fixed into the body 18 is a small linear actuator which can be a single acting hydraulic ram 35. The piston 36 of this ram 35 is engageable with the lug 30.

Figure 7:
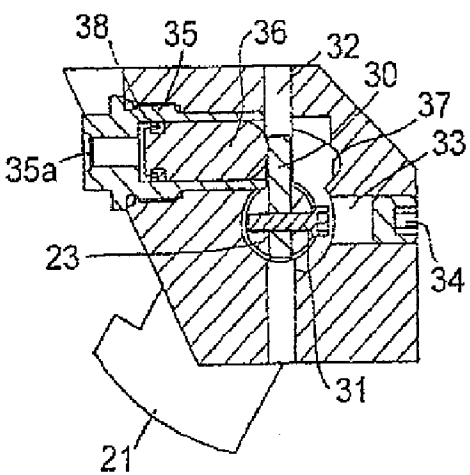
FIG. 7 is a section taken on line B-B.

Under the action of the coil spring 25 the knuckle 21 extends, in its normal or rest position, downwardly as shown in FIG. 7. In this position the piston 36 is pushed back into the body of the ram 35 by virtue of the restoring action of spring 25. This retracted position establishes a limit to the extent to which the shaft 23 can rotate.

Figure 10:
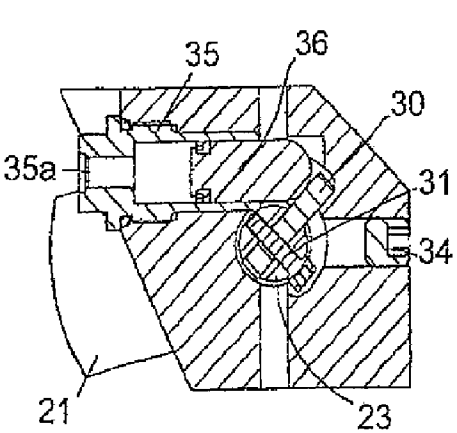
FIG. 10 is a section on line D-D.
Figure 11:
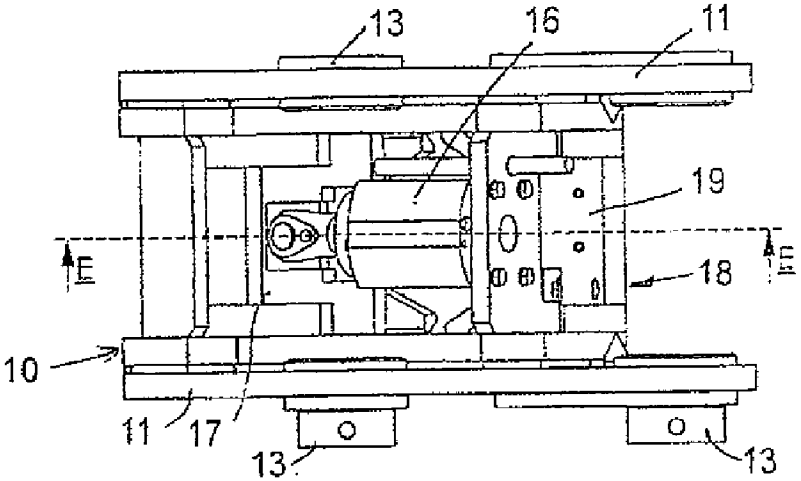
FIG. 11 is a top plan view of a quick hitch with the safety locking device.

When the hydraulic ram 35 is operated the piston 36 extends and pushes against the lug 30 thereby moving the lug until it reaches an end point established by stop surface 37. This is shown in FIG. 10. The knuckle 21 is thus raised into its unlocked position against the action of the bias of spring 25.

When the hydraulic pressure is released from the ram 35 the action of the spring 25 will cause the shaft 23 to rotate and hence the interaction between the lug 30 and the piston 36 will cause the piston to move back into the position shown in FIG. 7. Hence the knuckle 21 will move back into its locked position.

The hydraulic supply conduit (not shown) which connects at point 35*a* of the ram 35 is a separate conduit to that which operates the ram of the locking mechanism. Hence the hydraulic circuit for the safety locking device is independent of the hydraulic circuit used for operating the ram 16 of quick hitch locking mechanism. As a result of this any failure in the hydraulic circuit e.g. failure of the seal 38 in the piston 36 will have no effect on the locking mechanism of the quick hitch.

Figure 14:
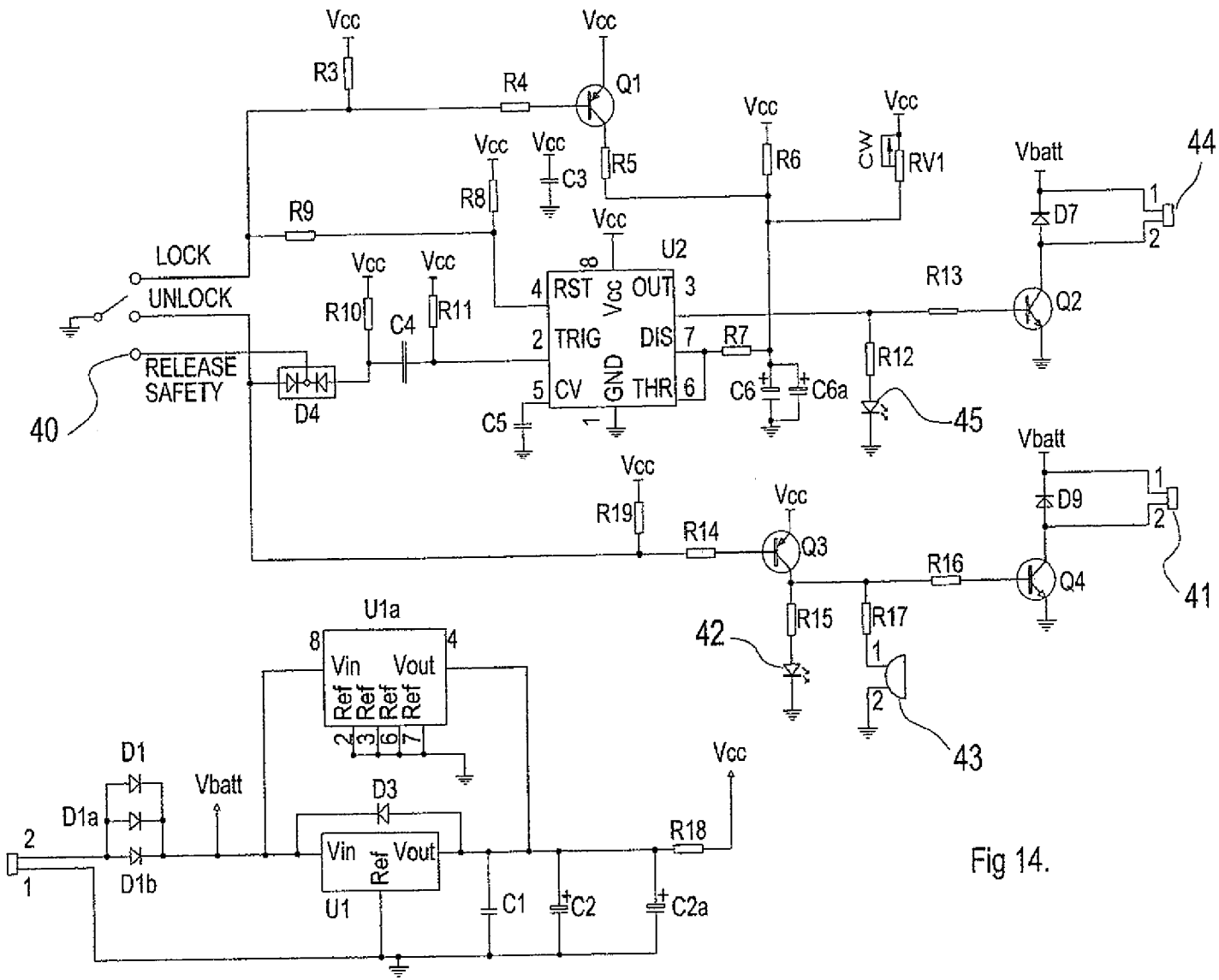
FIG. 14 is a circuit diagram of the controlled circuit for the quick hitch safety locking device.
Figure 17:
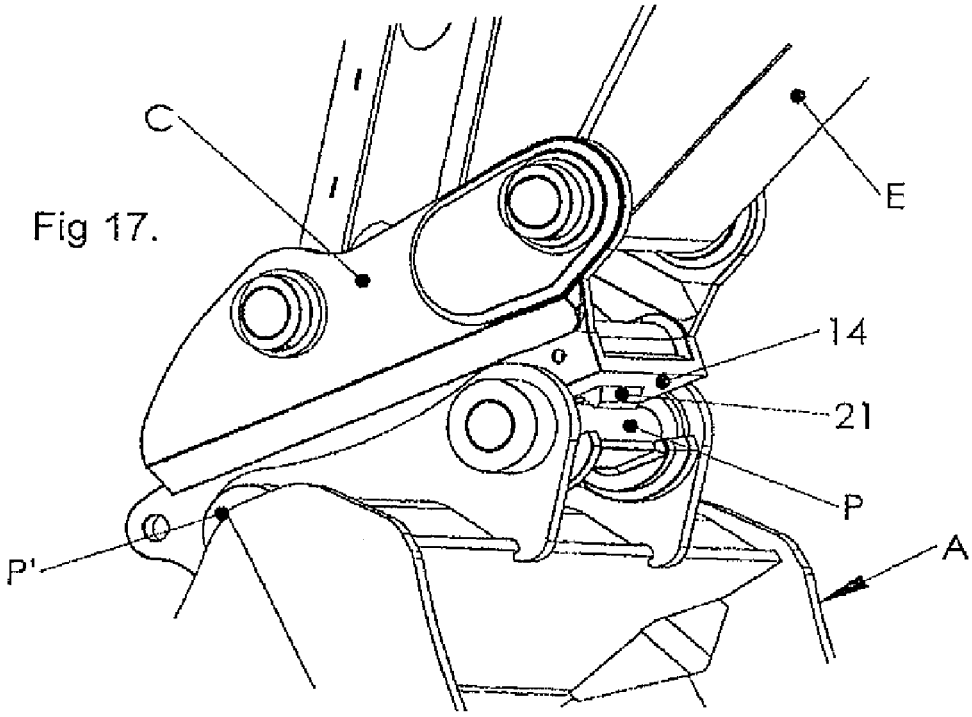

In a preferred embodiment of the invention the safety locking device is operated by a switching arrangement which, as shown in FIG. 14, is in one preferred form of the invention, a rotary switch 40. This switch 40 is formed as part of a control or solenoid driver circuit as shown in FIG. 14.

The solenoid 41 of the quick hitch locking mechanism is coupled to the rotary switch 40. As shown in FIG. 14 this circuit includes a visual warning device (e.g. an LCD 42 and a buzzer 43.

Also connected to the rotary switch 40 is a solenoid 44 for operation of the safety locking device. This circuit includes its own visual indicator such as LCD 45.

To further describe the circuit diagram and the hydraulic circuits of the quick hitch and safety locking device reference will be now made to the quick hitch operation sequence. This is a description which is based on the different positions of the rotary switch 40.

In position 1, or the lock position of the rotary switch 40, the normal operating position of the quick hitch will exist i.e. the locking wedge 17 will be extended and locked onto the back pin under hydraulic pressure and the safety locking device will be in its locked or safe position.

As a result no power will be supplied to the directional control solenoid valves. The quick hitch and safety locking device solenoids 41 and 44 will be closed allowing "low" pressure oil to the extended side of the quick hitch cylinder 16 only thereby causing the wedge 17 to extend. As is apparent from the foregoing description the knuckle 21 of the safety locking device 18 is in the extended position and held therein due to the load of the spring 25.

With the rotary switch 40 moved to the release wedge 17 or "unlock" position, the wedge can be disengaged from the back pin but the safety locking device 18 will remain in its closed locking position.

In this situation the LED 42 will illuminate and the buzzer 43 will sound. Power is supplied to the quick hitch solenoid 41 only allowing "high" pressure oil to flow into the retract side of the hitch cylinder 16 opening the pilot operator check valve thereof and causing the wedge 17 to retract. The "low" pressure oil on the extend side of the cylinder 16 is able to flow back to the hydraulic tank (not shown) of the hydraulic system bypassing the "low" pressure reducing valve which forms part of the hitch hydraulic circuit.

The rotary switch 40 can now be moved to the release position where the implement attached to the hitch can be disengaged i.e. the wedge 17 will be in its retracted position and the safety locking device 18 will be in its open or unlocked position (i.e. knuckle 21 retracted).

in this situation the LED 45 will be illuminated and the LED 42 and buzzer 43 will continue to operate. Power will thus be supplied to the safety device solenoid 44 allowing "high" pressure oil to flow to the extend side of the cylinder 35 thereby extending the piston 36 to cause the knuckle 21 to rotate out of the hook section 14 opening and into the body 19 of the safety locking device 18. At this point the hitch 16 cylinder will have no pressure to either side as both sides of the cylinder will be open to the tank.

The attachment or implement can therefore be removed from the quick hitch.

The safety locking device 18 is, via the circuitry connected to the latch solenoid 44, able to be "re-set" by one of two different methods.

By returning the rotary switch 40 to the release wedge position, power supply to the latch solenoid 44 will be removed thereby allowing the safety knuckle 21 to rotate back into the opening of hook section 14 under the action of the spring 25.

The circuitry also provides a time delay which is adjustable in duration of, say, between 4 and 10 seconds. After the elapsed time the timer switches off the power supply to the solenoid 44 allowing the knuckle 21 to rotate into its closed position.

When the safety locking device is reset safety cylinder 35 has no pressure on the piston 36 and the piston is retracted back via the spring 25 acting on the safety knuckle 21 as described above. The hitch is therefore ready for engagement to another attachment or implement.

FIGS. 15 to 20 graphically illustrate the use of a coupler with an attachment, the coupler incorporating the safety locking device according to the present invention.

FIG. 15 illustrates the coupler C mounted to an excavator arm E in accordance with conventional procedure. The coupler C is approaching the attachment (e.g. bucket) A. The knuckle 21 is shown in its extended or projecting position.

FIG. 16 illustrates the coupler C having engaged with the front pin P and with a locking knuckle 21 engaged over the front pin P so that the pin is locked into the open end of the hook portion 14 of the coupler C.

FIG. 16 shows the coupler having been moved so as to engage with the rear pin P' and the locking wedge 17 extended and locked onto the back pin P' under the hydraulic pressure of the ram 16. The coupler is now engaged with the attachment A and ready for use as normal.

Figure 18:
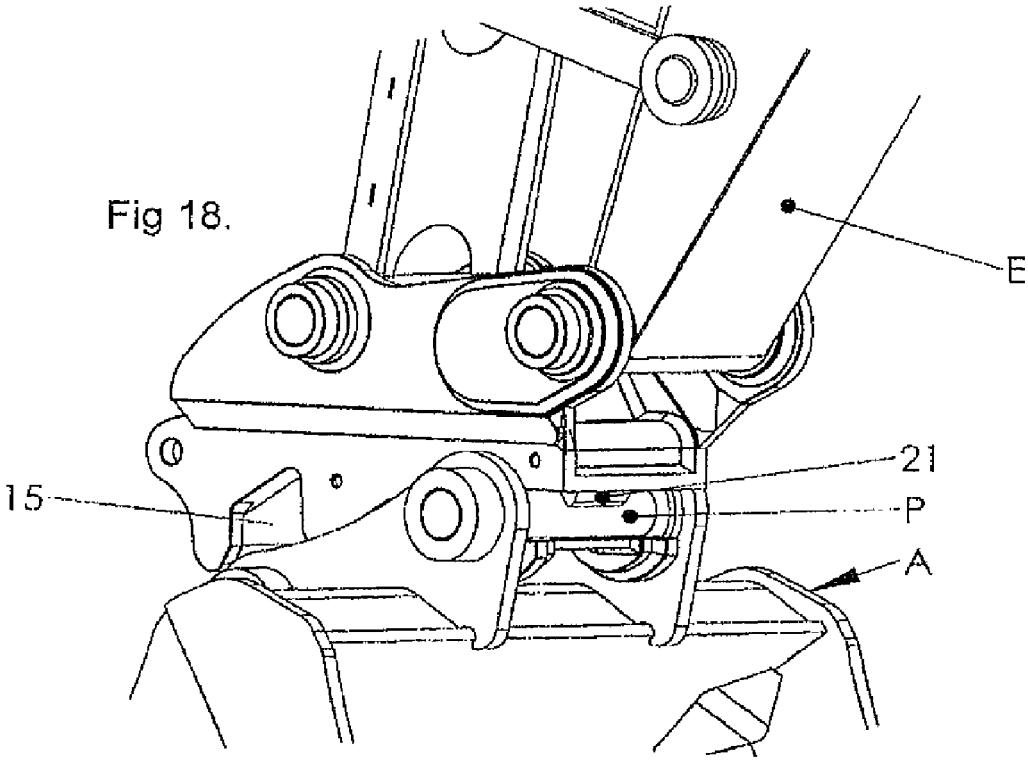

FIG. 18 illustrates the attachment A having been lowered onto a surface and the primary locking wedge 17 disengaged which enables the coupler C to disengage the pack pin P' from the mounting portion 15. It will be noted that the locking knuckle 21 is still engaged with the front pin P so that front pin P cannot be disengaged from the hook portion 14.

Figure 19:
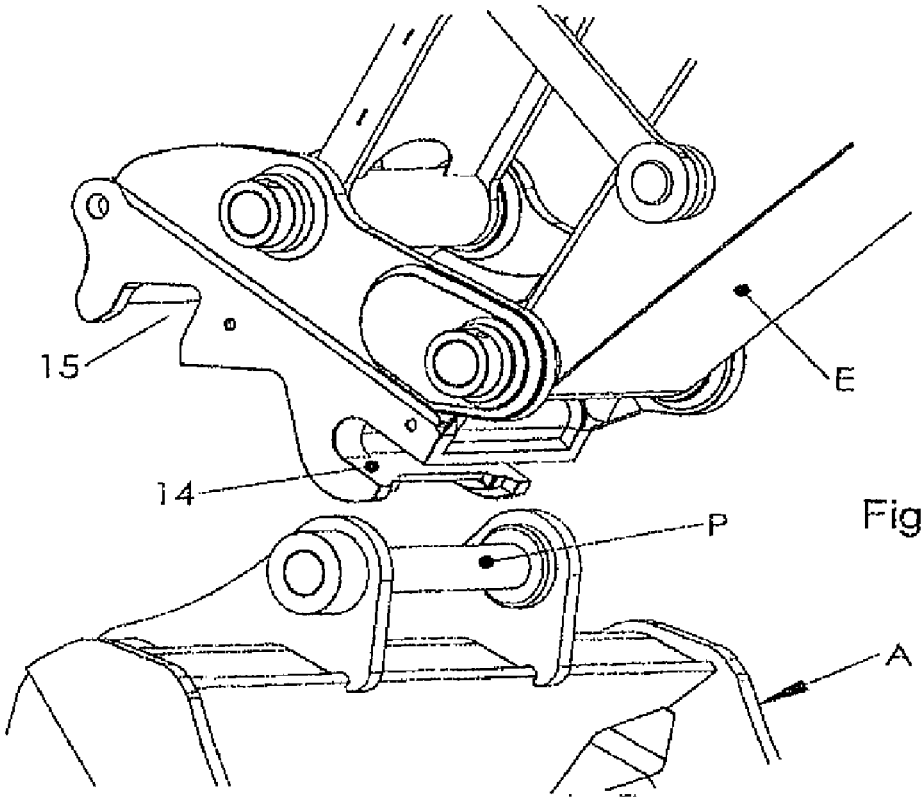
Figure 20:
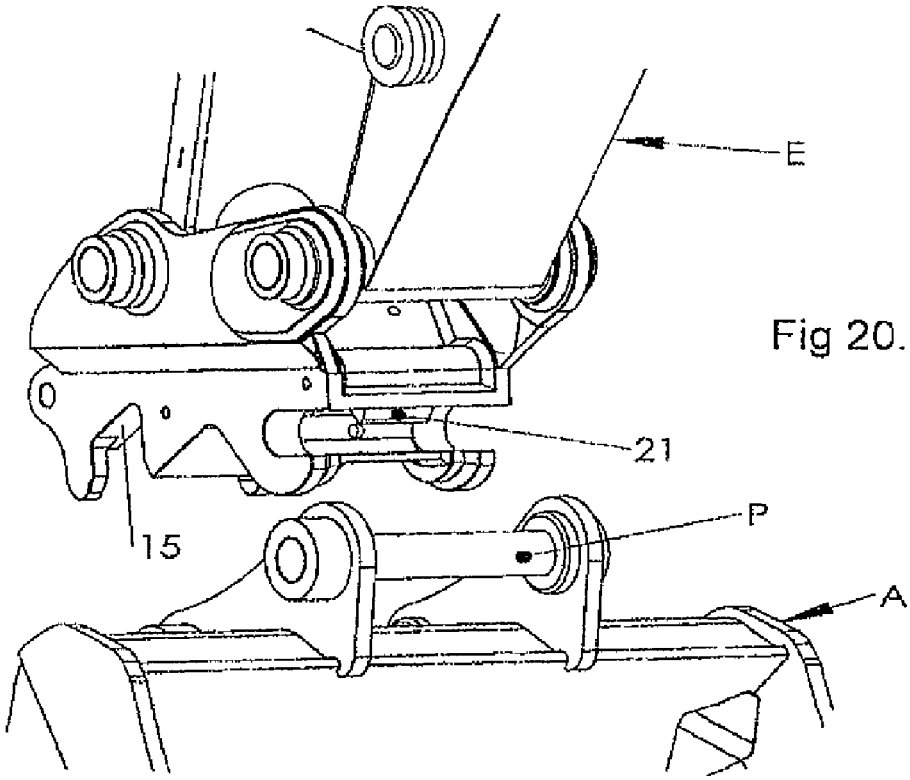

FIG. 19 shows that the lock knuckle 21 has been released thereby enabling the coupler C to be detached from the attachment A.

FIG. 10 shows the coupler C ready to re-connect with the attachment A. It will be noted W that the locking knuckle 21 has now reverted to the extended or projecting position and therefore when the coupler C is presented to and engages with the front pin P the locking knuckle will retract then under the spring bias will re-extend to automatically lock the front pin P into position once the pin P has moved into the throat of the hook portion 14.

It will be appreciated by those skilled in the art that the safety device is open to modification. For example the knuckle could be of a sliding construction rather than rotating. It could also have a pivoting action.

A further worthwhile modification is shown in FIGS. 21 to 24 which illustrates how the lug 30 can be formed with a hook type profile (in cross section) which ensures that the centre line of the piston 36 remains in full contact with the lug 30. This modification overcomes any possibility that the piston 36 can slide off the lug 30 especially when the lug 30 is towards the end of its movement as shown in FIG. 10.

Figure 22:
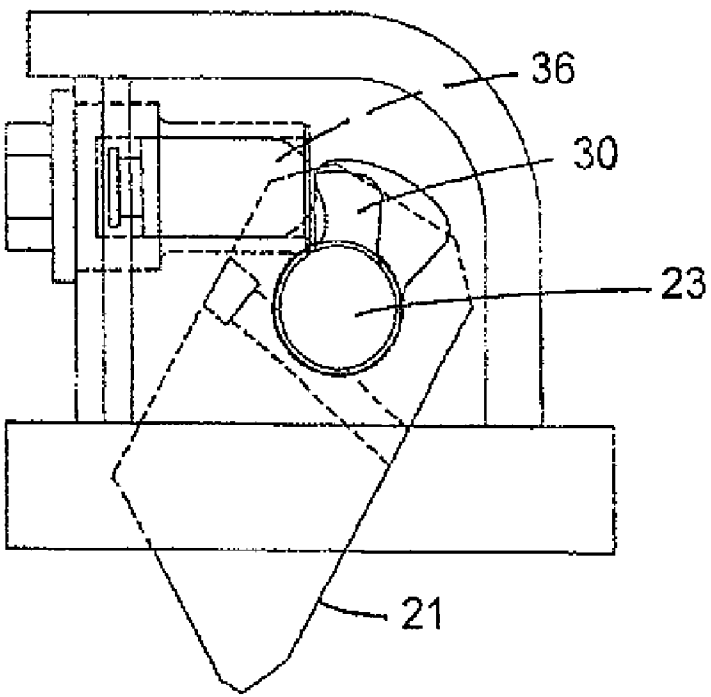
FIG. 22 is a view similar to FIG. 21 but showing the knuckle extended.
Figure 21:
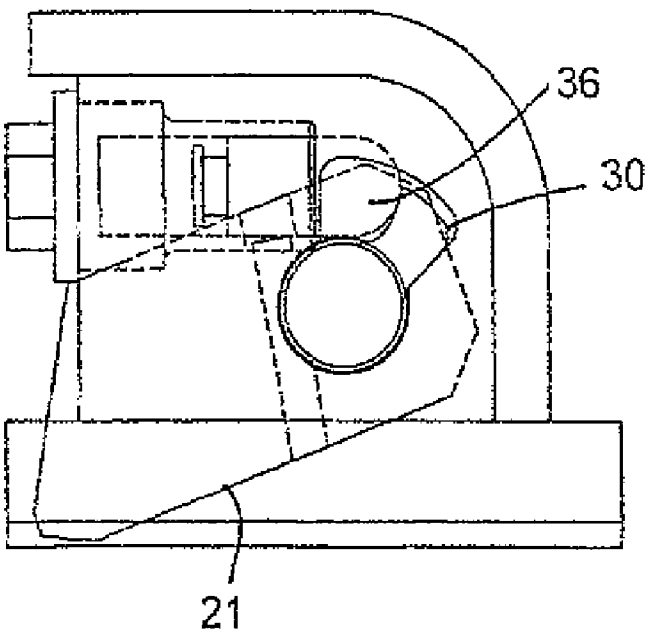
FIG. 21 is a cross sectional elevation of the safety locking device showing a modification to the lug incorporated within the device and engaged by an hydraulically operated piston and a modified form of the locking knuckle.
Figure 23:
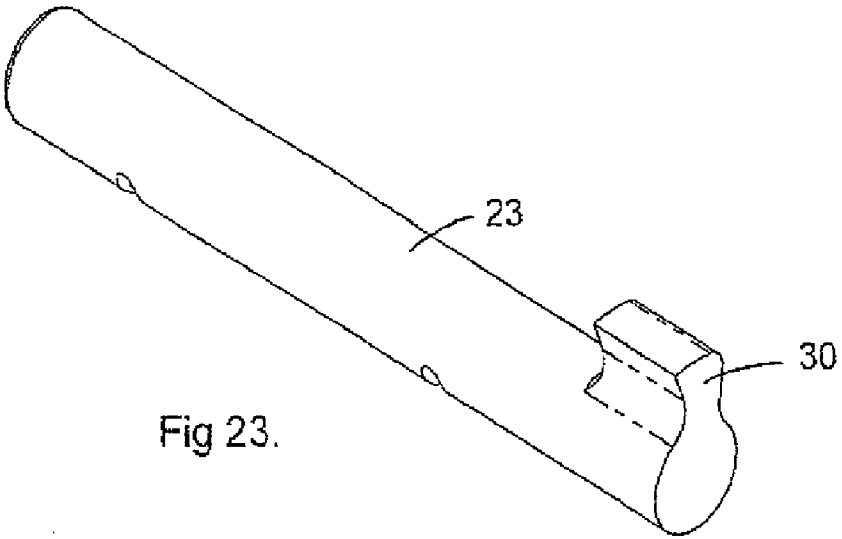
FIG. 23 is a perspective illustration of the modified lug and its associated shaft.
Figure 24:
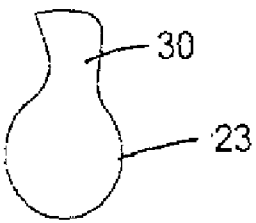
FIG. 24 is an end elevation of the modified lug.

FIGS. 21 and 22 show a further modification that can be made to the locking device. FIG. 21 shows the knuckle in the raised or retracted position while FIG. 22 shows the knuckle extended.

In the event that the bucket/attachment A is not latched correctly (or fails) at the primary locking mechanism (wedge) end and the bucket/attachment rotates and swings uncontrolled in the hock section 14, the front bucket pin P will usually come into contact with the face of the knuckle 21 as the attachment/bucket swings pivotally in an arc. In such a situation the safety knuckle 21 carries out its required function of preventing unintentional release of the entire attachment/bucket from the coupler C.

Figure 3:
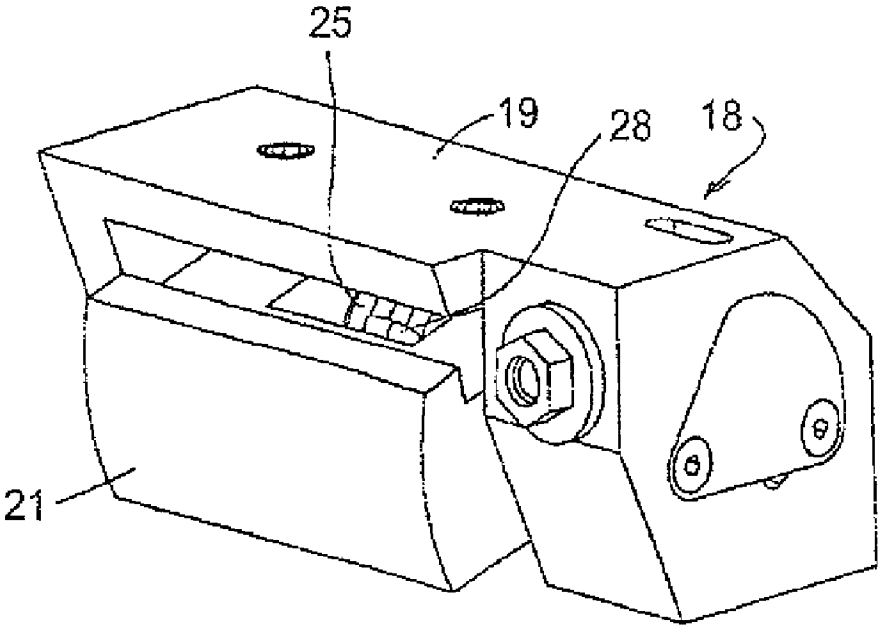
FIG. 3 is a perspective view of the safety locking device when in its unlocked position.
Figure 4:
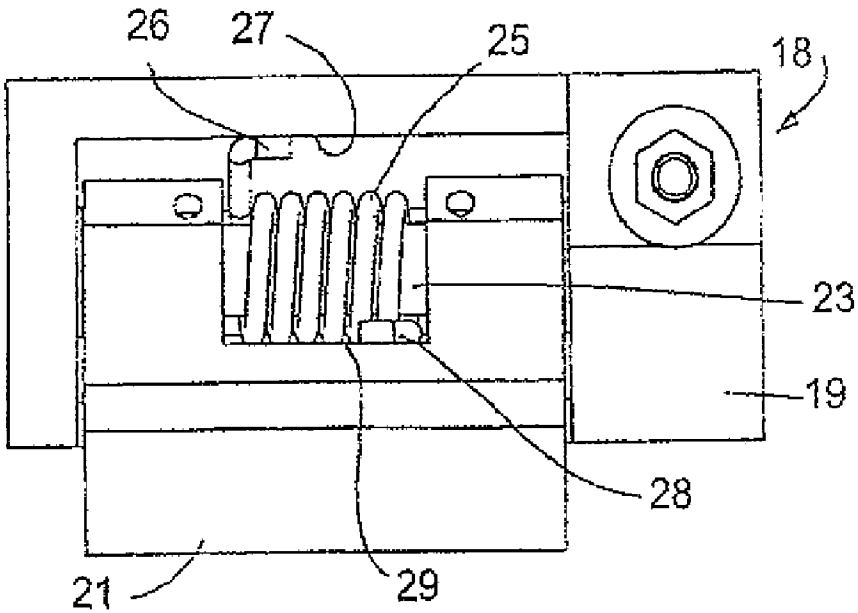
FIG. 4 is a rear elevation view of the safety locking device in the locked position.
Figure 6:
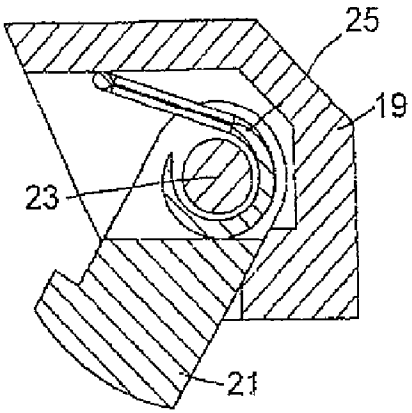
FIG. 6 is a section taken on line A-A.
Figure 9:
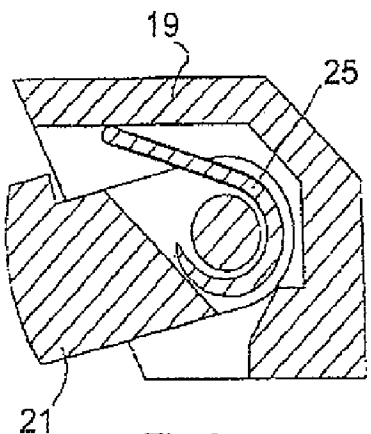
FIG. 9 is a section on line C-C.
Figure 5:
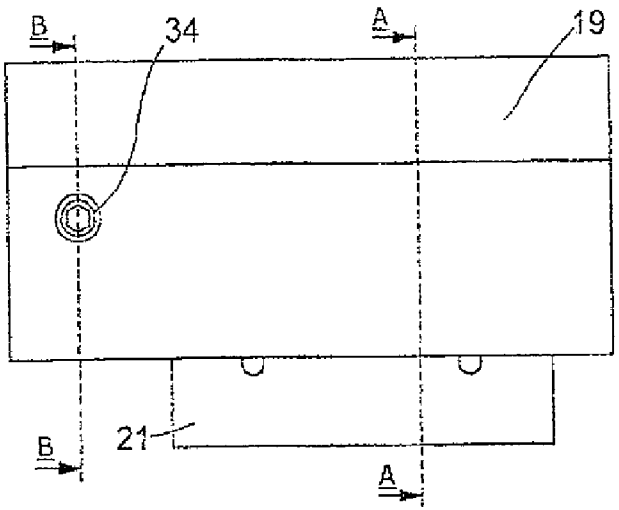
FIG. 5 is a front elevation view of the safety locking device when in the locked position.
Figure 8:
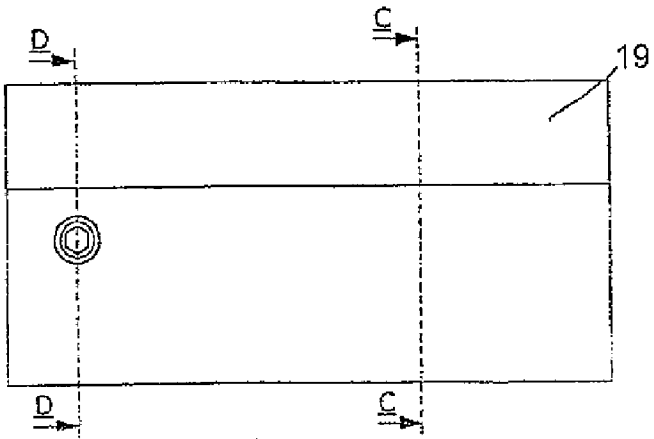
FIG. 8 is a front view of the safety locking device when in the unlocked position.

However, with the more radial face shape as shown in the embodiment of for example, FIGS. 3, 6 and 7, this contact between the pin P and the face of the knuckle 21 could tend to result in the contacting surfaces working like two meshing gears and roll the knuckle up into the retracted position and thereby enable the pin P to be released from the hook portion 14. With the modified more angular face surface of the knuckle shown in FIGS. 21 and 22, this possibility of meshing/rolling is prevented and thereby overcomes any possibility of the knuckle being forced upwardly by the pin P.

The present invention thus provides a safety locking device which is operable independent of the hydraulics of the coupler/quick hitch. The safety locking device is of a fail safe construction and either via manual re-set or timing out of the circuitry controlling the solenoid 44 will always return to a position whereby it will automatically latch the front pin upon the front pin being inserted into the opening of the hook portion 14 of the quick hitch.

The present invention differs from other safety systems used with couplers in that with known safety systems the coupler engages with the front pin and the primary lock (e.g. sliding wedge) is engaged and following this the secondary or safety lock is operated. There is thus a period of time when the attachment is engaged with the coupler but the safety lock is not engaged. Thus there is a risk period before the engagement of the safety lock. With the present invention, however, the coupler engages with the front pin and the safety lock device immediately operates and does so before the primary lock (e.g. sliding wedge) is activated. Therefore, there is minimal time between the coupler C coming into engagement with the attachment before the safety lock device becoming effective.

This minimal time period also applies in the unlocking sequence.

The invention claimed is:

1. A method for attaching an implement to an arm of an earth working machine, comprising the steps of:

providing a coupler on an end of the arm, the coupler having an upwardly facing portion adapted to fix the coupler to the end of the arm, a hydraulically controlled locking mechanism including a first actuator, a downwardly facing mounting portion positioned near one end of the coupler, and an outwardly facing hook portion positioned near an opposite end of the coupler;

positioning the arm with the coupler near the implement, the implement comprising a front pin and a rear pin;

engaging and locking the front pin of the implement within the hook portion of the coupler with a safety locking mechanism, wherein the safety locking mechanism moves from an unlocked position independently of operation of either one of a second actuator operable to move the safety locking mechanism to the unlocked position and the first actuator;

engaging the rear pin of the implement with the mounting portion; and locking the rear pin within the mounting portion with the hydraulically controlled locking mechanism.

2. The method of claim 1, wherein the safety locking mechanism immediately and independent of urging by the front pin moves from the unlocked position to lock the front pin of the implement within the hook portion when the hook portion engages the front pin.

3. The method of claim 1, wherein the safety locking mechanism operates independently of the hydraulically controlled locking mechanism.

4. The method of claim 1, wherein the safety locking mechanism locks the front pin within the hook portion prior to the coupler engaging the rear pin of the implement.

5. The method of claim 1, wherein the safety locking mechanism operates under a bias to lock the front pin of the implement within the hook portion of the coupler.

6. The method of claim 5, wherein locking the front pin with the safety locking mechanism comprises rotating a knuckle into a locking position to retain the front pin within the hook portion.

7. The method of claim 1, wherein locking the front pin with the safety locking mechanism comprises sliding a knuckle into a locking position to retain the front pin within the hook portion.

8. The method of claim 1, wherein locking the front pin with the safety locking mechanism comprises pivoting a knuckle into a locking position to retain the front pin within the hook portion.

9. The method of claim 1, further comprising detaching the implement from the arm of the earth working machine after the implement has been attached to the arm, comprising the steps of:

hydraulically unlocking the rear pin in the mounting portion of the coupler;

moving the mounting portion to release the rear pin from the coupler;

hydraulically unlocking the front pin in the hook portion of the coupler; and moving the hook portion to release the front pin from the coupler;

wherein hydraulically unlocking the front pin comprises using a hydraulic circuit that is independent of a hydraulic circuit for unlocking the rear pin.

* * * * *

UNITED STATES PATENT AND TRADEMARK OFFICE

CERTIFICATE OF CORRECTION

PATENT NO. : 8,347,974 B2
APPLICATION NO. : 12/892023
DATED : January 8, 2013
INVENTOR(S) : Matthew James Calvert It is certified that error appears in the above-identified patent and that said Letters Patent is hereby corrected as shown below:

In the Specification

Col. 5, Line 53

Change "It will be noted W that the locking knuckle 21"

to read --It will be noted that the locking knuckle 21--.

Signed and Sealed this
First Day of October, 2013

Teresa Stanek Rea

Teresa Stanek Rea
*Deputy Director of the United States Patent and Trademark Office*